US008134288B2

(12) United States Patent
Motoi et al.

(10) Patent No.: US 8,134,288 B2
(45) Date of Patent: Mar. 13, 2012

(54) ELECTRON-EMITTING DEVICE, ELECTRON SOURCE, AND IMAGE DISPLAY APPARATUS

(75) Inventors: Taiko Motoi, Atsugi (JP); Eiji Ozaki, Tokyo (JP); Ryoji Fujiwara, Chigasaki (JP); Akiko Kitao, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/970,849

(22) Filed: Dec. 16, 2010

(65) Prior Publication Data

US 2011/0148281 A1 Jun. 23, 2011

(30) Foreign Application Priority Data

Dec. 21, 2009 (JP) ..... 2009-289728

(51) Int. Cl.
*H01J 17/49* (2006.01)

(52) U.S. Cl. ..... 313/483; 313/495

(58) Field of Classification Search ..... 313/495–497, 313/483
See application file for complete search history.

(56) References Cited

U.S. PATENT DOCUMENTS 5,938,495 A 8/1999 Ito
2010/0308717 A1 * 12/2010 Kitazume et al. ..... 313/504

FOREIGN PATENT DOCUMENTS

EP 806785 A2 11/1997
JP 5-021002 A 1/1993
JP 9-306339 A 11/1997
JP 2001-167693 A 6/2001

* cited by examiner

*Primary Examiner* — Anne Hines
(74) *Attorney, Agent, or Firm* — Canon U.S.A., Inc., IP Division

(57) ABSTRACT

An electron-emitting device includes an electron-emitting film containing molybdenum. A spectrum obtained by measuring a surface of the electron-emitting film by X-ray photoelectron spectroscopy has a first peak having a peak top in the range of 229±0.5 eV and a sub peak having a peak top in the range of 228.1±0.3 eV.

6 Claims, 13 Drawing Sheets

ELECTRON-EMITTING DEVICE, ELECTRON SOURCE, AND IMAGE DISPLAY APPARATUS

BACKGROUND OF THE INVENTION

1. Field of the Invention

The present invention relates to an electron-emitting device, an electron source, and an image display apparatus.

2. Description of the Related Art

Field-emission-type electron-emitting devices are attracting increasing attention. Japanese Patent Laid-Open No. 05-021002 discloses formation of $MoO_3$ oxide films on surfaces of a gate layer and an emitter chip composed of metallic molybdenum and removal of the oxide films to correct the shape of the emitter chip and adjust the distance between the emitter chip and the gate layer. Japanese Patent Laid-Open No. 09-306339 discloses formation of a $MoO_3$ film on a surface of a molybdenum cathode and removal of the $MoO_3$ film by subsequent heating. Japanese Patent Laid-Open No. 2001-167693 discloses an electron-emitting device that includes an insulating layer having a recess in a surface and a pair of conductive films.

SUMMARY OF THE INVENTION

An aspect of the present invention provides an electron-emitting device that includes an electron-emitting film containing molybdenum. A spectrum obtained by measuring a surface of the electron-emitting film by X-ray photoelectron spectroscopy has a first peak having a peak top in the range of 229±0.5 eV and a sub peak having a peak top in the range of 228.1±0.3 eV.

Further features of the present invention will become apparent from the following description of exemplary embodiments with reference to the attached drawings.

DESCRIPTION OF THE EMBODIMENTS

Embodiments will now be described with reference to the drawings.

Figure 2A:
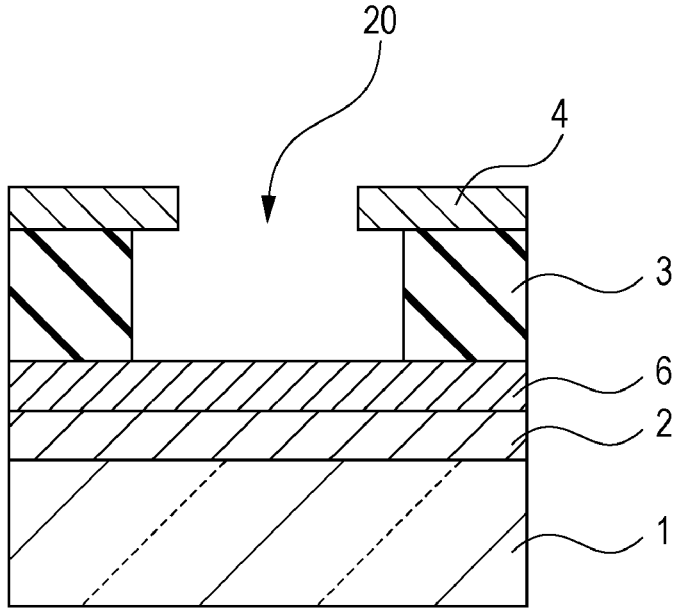
FIGS. 2A and 2B are schematic views showing examples of the structure of an electron-emitting device.

FIG. 2A is a schematic cross-sectional view showing an example of a structure of an electron-emitting device including an electron-emitting film 6. A cathode electrode 2 is disposed on a substrate 1, and the electron-emitting film 6 containing molybdenum (referred to as "Mo" hereinafter) is disposed on the cathode electrode 2. In order to induce field emission of electrons from the electron-emitting film 6, in this example, a gate electrode 4 having an aperture 20 is provided above the electron-emitting film 6 with an insulating layer 3 between the gate electrode 4 and the electron-emitting film 6. A potential higher than the potential of the cathode electrode 2 is applied to the gate electrode 4 to supply the surface of the electron-emitting film 6 with an electric field sufficient to withdraw electrons from the electron-emitting film 6, thereby inducing emission of electrons from the electron-emitting film 6.

The substrate 1 is, for example, a quartz substrate or a glass substrate and is a support that supports the cathode electrode 2, the electron-emitting film 6, and other associated components. An electrically conductive substrate can be used as the substrate 1 if the outermost surface of the substrate 1 in contact with the cathode electrode 2 is formed by an insulating material. For example, a substrate prepared by forming silicon nitride (typically $Si_3N_4$) or silicon oxide (typically $SiO_2$) on a surface of a silicon substrate may be used as the substrate 1.

The cathode electrode 2 and the gate electrode 4 are electrically conductive and may be composed of materials that have high thermal conductivity and high melting points. For example, metals such as Be, Mg, Ti, Zr, Hf, V, Nb, Ta, Mo, W, Al, Cu, Ni, Cr, Au, Pt, and Pd or alloys thereof can be used. Carbides, borides, and nitrides can also be used. The film thickness is determined according to the structure of the electron-emitting device. Practically, the film thickness is set within the range of several ten nanometers to several micrometers. The cathode electrode 2 and the gate electrode 4 may be made of the same material or different materials.

The electron-emitting device can form a 3-terminal electronic device when the electron-emitting device is installed inside an airtight container kept at a pressure lower than the atmospheric pressure together with an anode (not shown) located away from the gate electrode 4 and the cathode electrode 2. According to such a 3-terminal electronic device, electrons emitted from the electron-emitting film 6 by field induction are applied to the anode by applying to the anode a potential sufficiently larger than the potential applied to the gate electrode 4. A light-emitting device can be formed when a light-emitting member such as a phosphor that emits light by irradiation with electrons is provided to the anode. When a large number of such light-emitting devices are aligned, an image display apparatus (display) can be formed. The detailed structures of the image display apparatus and the light-emitting device are disclosed in Japanese Patent Laid-Open No. 2001-167693 described above, etc.

Figure 2B:
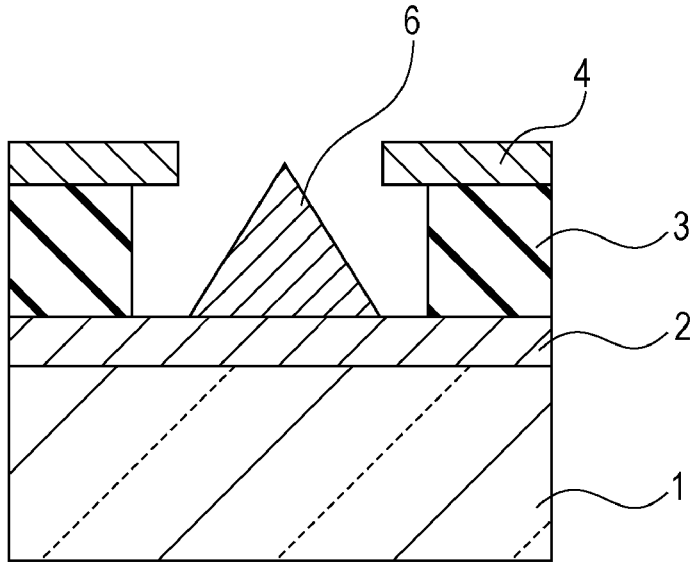

FIG. 2A shows an electron-emitting film 6 having a flat surface. Alternatively, the electron-emitting film 6 may have a protruding portion as shown in FIG. 2B. In other words, there is not a limit as to the shape of the electron-emitting film 6. However, in order to increase the intensity of the electric field applied to the surface of the electron-emitting film 6, the surface of the electron-emitting film 6 may have a large number of protruding portions.

In order to form an electron-emitting film 6 having a protrusion on the surface as shown in FIG. 2B, the substrate 1 may be processed in advance so that the surface of the substrate 1 has a protrusion. Alternatively, the substrate 1 may be left unprocessed and the cathode electrode 2 may be processed to form a protrusion on the surface of the cathode electrode 2. When this is done, a protrusion can be formed on the surface of the electron-emitting film 6 since the surface profile of the electron-emitting film 6 formed by deposition resembles the surface profile of the substrate 1 or cathode electrode 2. An electron-emitting film 6 having a conical shape can be formed by placing a gate electrode 4 having a circular aperture 20 above a flat surface of the cathode electrode 2 with a distance between the surface of the cathode electrode 2 and the gate electrode 4 and then forming an electron-emitting film 6 through the aperture 20 by sputtering. This method is disclosed Japanese Patent Laid-Open No. 08-2555612.

Figure 6A:
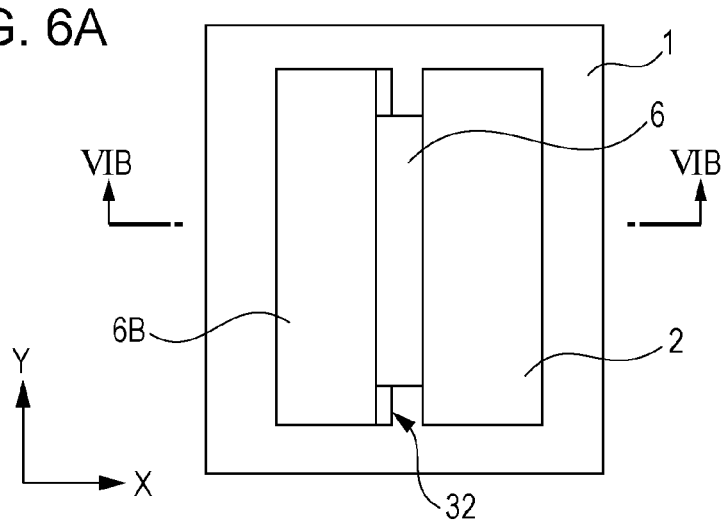
FIGS. 6A to 6C are schematic views showing another example of the structure of the electron-emitting device.
Figure 6B:
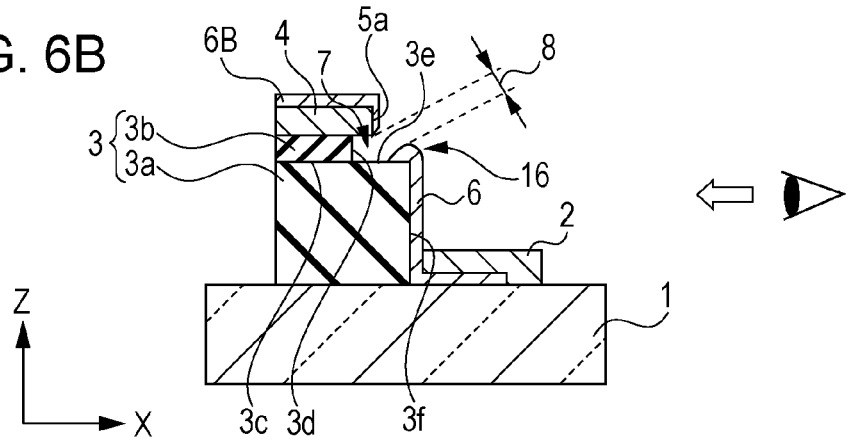
Figure 6C:
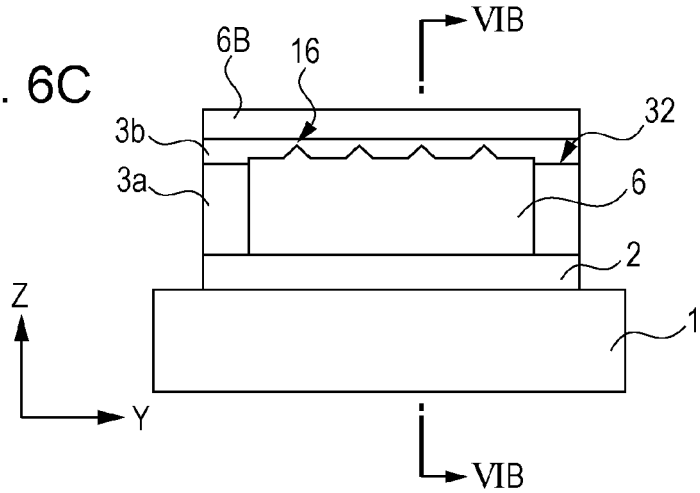

Regarding the design of the electron-emitting device, an electron-emitting film may be formed at the side surface of the insulating layer 3 as shown in FIGS. 6A to 6C, which is described in detail in Example 2 below.

Figure 1:
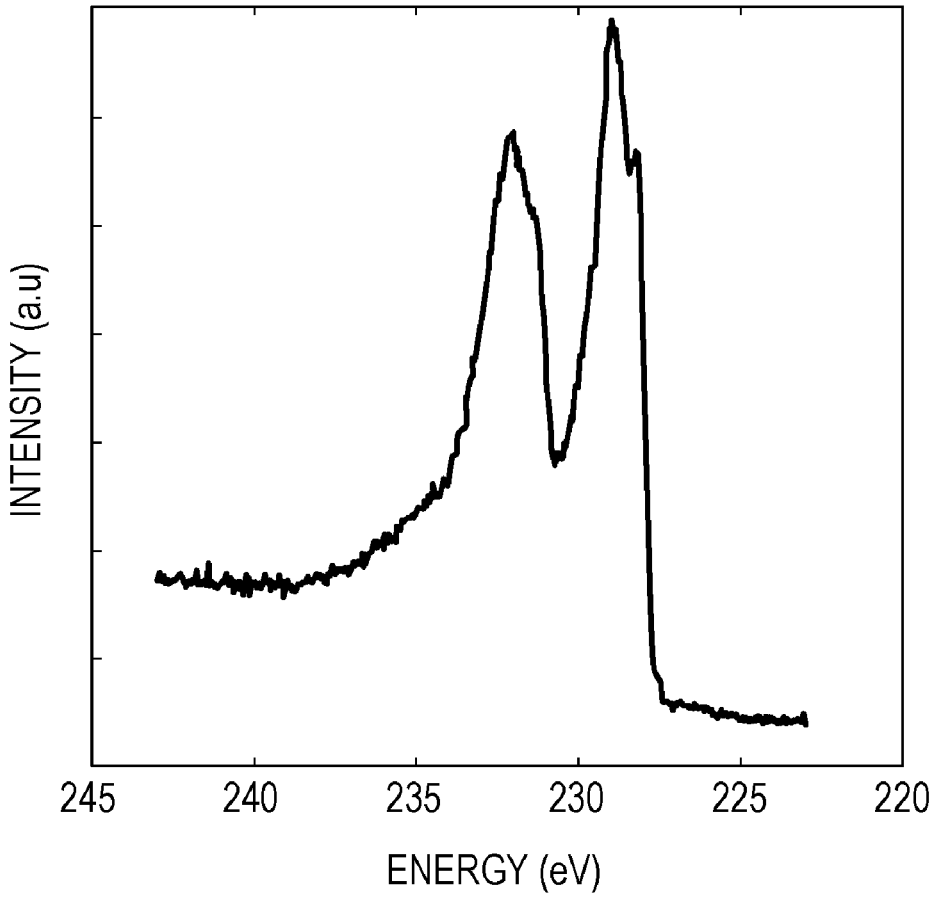
FIG. 1 is an X-ray photoelectron spectrum of a film containing molybdenum.

The electron-emitting film 6 is a Mo-containing film containing molybdenum in various states. FIG. 1 is a diagram showing a typical spectrum profile of the Mo-containing film 6 measured by X-ray photoelectron spectroscopy (XPS). In FIG. 1, the horizontal axis indicates bond energy (eV) and the vertical axis indicates the intensity (arbitrary units). The Mo-containing film 6 has a first peak having a peak top in the range of 229±0.5 eV and a full-width at half maximum (FWHM) of 1.5 to 2 eV. The first peak has a sub peak (also referred to as "third peak") that has a peak top in the range of 228.1±0.3 eV.

The Mo-containing film 6 also has a second peak having a peak top in the range of 232.5±0.5 eV and a full-width at half maximum (FWHM) of 1.5 to 2.7 eV.

The Mo-containing film can be made by a film-forming machine such as a sputtering machine while controlling the atmosphere during sputtering.

An electron source including a substrate and a plurality of electron-emitting devices on the substrate, each electron-emitting device including the electron-emitting film described above will now be described with reference to FIGS. 11A and 11B along with an image display apparatus that uses this electron source.

Figure 11A:
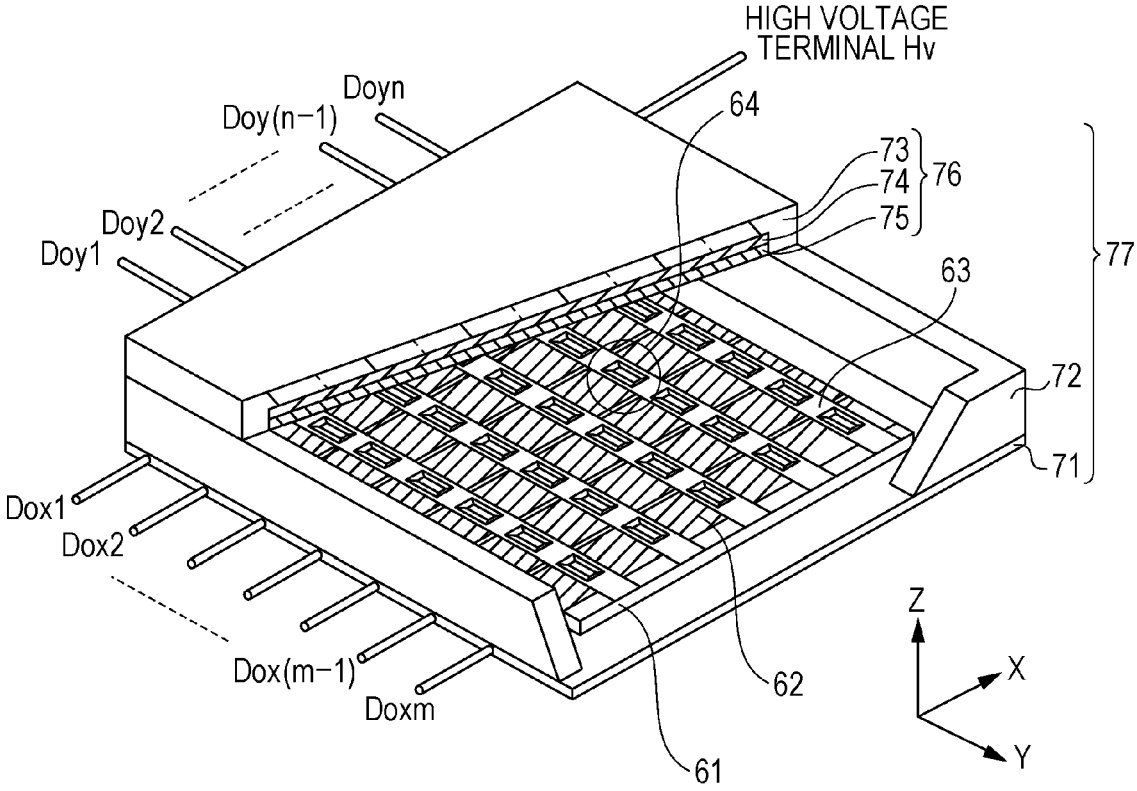
FIGS. 11A and 11B are schematic views showing an image display apparatus.
Figure 11B:
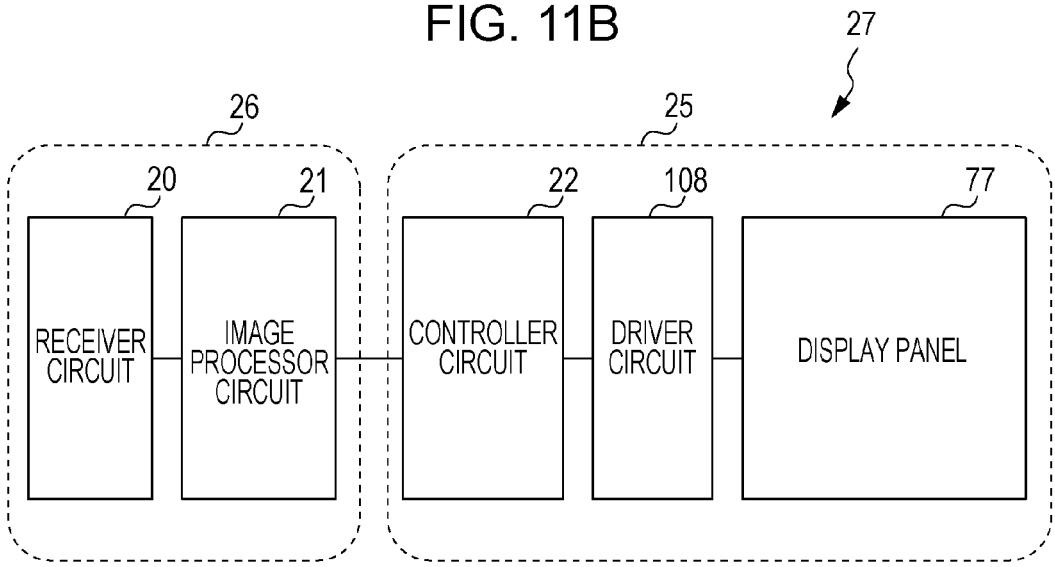

FIG. 11A is a schematic diagram showing an example of a display panel 77 that includes an electron source including electron-emitting devices aligned in a matrix. Part of the display panel 77 is cut away to expose the interior. Referring to FIG. 11A, the display panel 77 includes an electron source substrate 61, an X-direction wiring 62, a Y-direction wiring 63, and electron-emitting devices 64 corresponding to the electron-emitting device discussed above. The electron source substrate 61 corresponds to the substrate 1 of the electron-emitting device discussed above. The X-direction wiring 62 is wiring that provides common connection to the cathode electrodes 2 and the Y-direction wiring 63 is wiring that provides common connection to the gate electrodes 4. In the drawing, the example of forming electron-emitting devices at the intersections of the X-direction wiring 62 and the Y-direction wiring 63 is schematically illustrated. Alternatively, the electron-emitting devices can be formed on the electron source substrate 61 at positions on the side of the intersections of the X-direction wiring 62 and the Y-direction wiring 63.

The X-direction wiring 62 is connected to a scan signal feed unit (not shown) via terminals Dox1 to Doxm. The scan signal feed unit feeds a scan signal for selecting a row of the electron-emitting devices 64 aligned in the X direction. The Y-direction wiring 63 is connected to a modulating signal generating unit (not shown) via terminals Doy1 to Doyn. The modulating signal generating unit modulates the columns of electron-emitting devices 64 aligned in the Y direction in accordance with the input signal. The driver voltage (Vf) applied between the cathode electrode 2 and the gate electrode 4 of each electron-emitting device is equal to the difference voltage between the scan signal and the modulating signal.

According to this structure, electron-emitting devices can be individually selected and driven independently using simple matrix wiring.

In FIG. 11A, the electron source substrate 61 is affixed on a rear plate 71. A light-emitting member 74 composed of, for example, a phosphor, that emits light by irradiation with electrons emitted from the electron-emitting devices and a metal back 75 that corresponds to the aforementioned anode are stacked on an inner surface of a glass substrate 73 to form a face plate 76. The rear plate 71 is bonded airtight to the face plate 76 by using a supporting frame 72 and a bonding member (not shown) such as frit glass provided between the rear plate 71 and the face plate 76 to form the display panel 77. The display panel 77 is made up of the face plate 76, the supporting frame 72, and the rear plate 71, as described above. According to this design, the rear plate 71 is provided to mainly improve the strength of the electron source substrate 61. Accordingly, a separate rear plate 71 is not needed when the electron source substrate 61 itself has a sufficient strength. Alternatively, supporting members (not shown) called spacers may be installed between the face plate 76 and the rear plate 71 to impart a sufficient strength to the structure against the atmospheric pressure.

Next, image display apparatuses such as a display 25 equipped with the display panel 77 described above and a television system 27 are described with reference to the block diagram shown in FIG. 11B. The television system 27 may include a receiver unit 26 including a receiver circuit 20 and an image processor circuit 21.

The receiver circuit 20 includes a tuner, a decoder, etc., receives various kinds of signals such as television signals of satellite broadcasting and ground waves and signals of data broadcasting sent through networks, and outputs the decoded image data to the image processor circuit 21. The "received signals" can also be phrased as "input signals". The image processor circuit 21 includes γ correction circuit, a resolution conversion circuit, an I/F circuit, etc. The image processor circuit 21 converts the image data generated by image-processing into the display format of the display 25 and outputs an image signal to the display 25.

The display 25 includes the display panel 77, a driver circuit 108, and a controller circuit 22 that controls the driver circuit 108. The controller circuit 22 executes signal processing, such as correction, on the input image signal and outputs an image signal and various types of control signals to the driver circuit 108. The controller circuit 22 includes a sync signal separator circuit, an RGB conversion circuit, a luminance signal converter, a timing controller circuit, etc. The driver circuit 108 outputs a drive signal to the electron-emitting devices 64 in the display panel 77 on the basis of the input image signal. The image is displayed in the display panel 77 on the basis of the drive signal. The driver circuit 108 includes a scan circuit, a modulator circuit, a high-voltage source circuit that supplies the anode potential, etc. The receiver circuit 20 and the image processor circuit 21 may be housed in a casing separate from the display 25, such as a set top box (STB26) or may be housed in a casing integral with the display 25. Here, an example of displaying television images in the television system 27 is described. However, the television system 27 functions as an image display apparatus that can display various kinds of images not limited to television images when the receiver circuit 20 is configured to receive images distributed through lines such as the Internet.

Specific examples will now be described along with modifications.

EXAMPLES

Example 1

Figure 5:
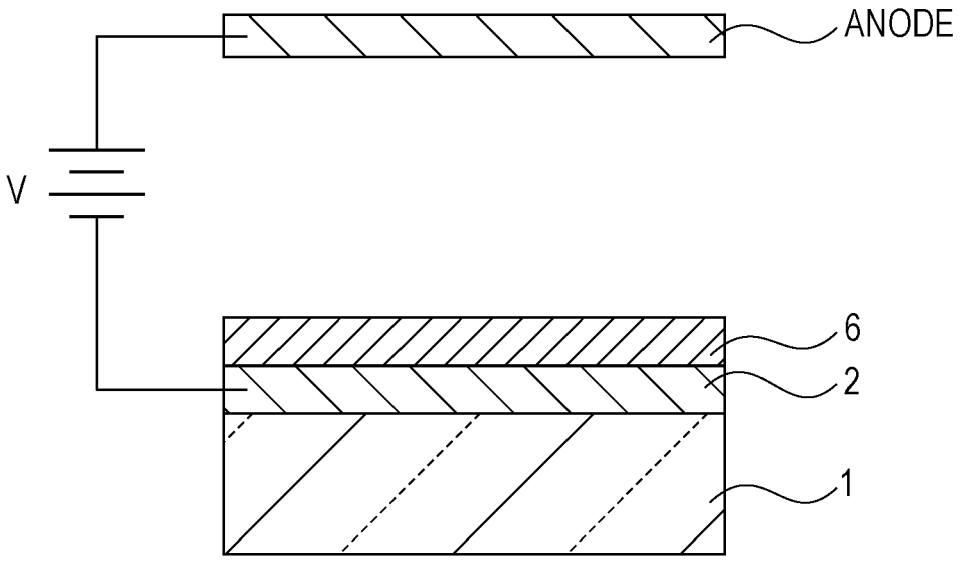
FIG. 5 shows an example of a structure for measuring electron-emission characteristics.

In Example 1, an electron-emitting device shown in FIG. 5 was made.

The substrate 1 was a quartz substrate. The cathode electrode 2 was composed of tantalum nitride (TaN) and had a thickness of 40 nm. The anode was formed 10 μm apart from the electron-emitting film (Mo-containing film) 6. The electron-emitting film 6 had a thickness of 30 nm and contained molybdenum.

The process of making the electron-emitting device will now be described.

Figure 7:
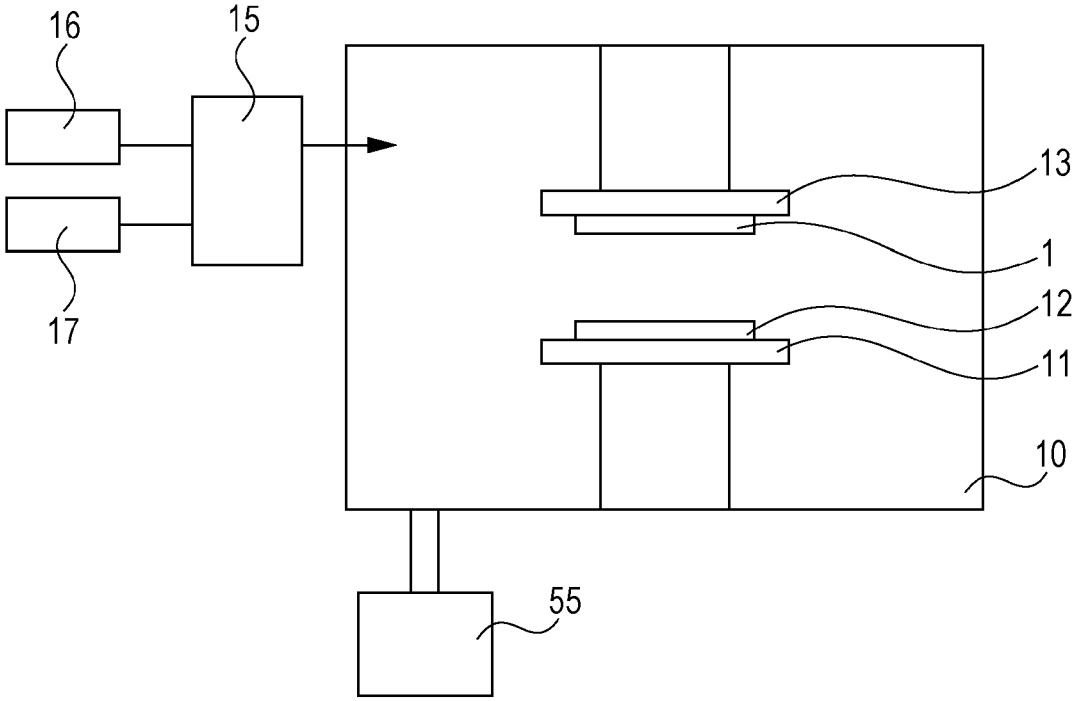
FIG. 7 is a schematic view showing one example of a structure of a film-forming machine.

FIG. 7 is a schematic diagram of a system for forming the electron-emitting film 6. A target holder 11 is installed in a chamber 10 connected to a vacuum pump 55, and a target 12 is placed on the target holder 11. The quartz substrate 1 retained in a substrate holder 13 is positioned to face the target 12. The target 12 is composed of metallic molybdenum. A target composed of molybdenum having a purity of 99.9% produced by TOSHIMA Manufacturing Co., Ltd., was used as the target 12.

A gas flow system 15 is connected to the chamber 10 to control the pressure and atmosphere inside the chamber 10. The gas flow system 15 is connected to an Ar gas cylinder 16 and an $O_2$ gas cylinder 17. The gas pressure from the Ar gas cylinder 16 and the gas pressure from the $O_2$ gas cylinder 17 can be controlled independently and mixed to be guided into the chamber 10 from the gas flow system 15.

First, a TaN film for forming the cathode electrode 2 was deposited to a thickness of 40 nm on a thoroughly washed quartz substrate 1 in the chamber 10 of the sputtering system shown in FIG. 7. Ar gas was used as the sputter gas and the pressure was set to 0.1 Pa.

Next, the electron-emitting film 6 was continuously deposited in the same chamber 10. The sputter gas was Ar and $O_2$, and the partial pressure ratio was 9:1. The total pressure in the chamber 10 was set to 1.7 Pa and the film was deposited to a thickness of 30 nm.

The substrate 1 with the electron-emitting film 6 was discharged from the chamber 10, and the electron-emitting film 6 was alkali-washed with tetramethylammonium hydroxide (TMAH). Although TMAH was used here, ammonia water, a mixture of 2(2-n-butoxyethoxy)ethanol and alkanol amine, dimethyl sulfoxide (DMSO), or the like may be used as a washing solution. The electron-emitting film 6 was then washed with running water and heat-treated at 400° C. for about 1 hour at a vacuum of 1 Pa.

The substrate 1 thus prepared was placed in a vacuum chamber. As shown in FIG. 5, the electron emission characteristic of the electron-emitting film 6 containing molybdenum was measured by placing the electron-emitting film 6 to face the anode.

Figure 8A:
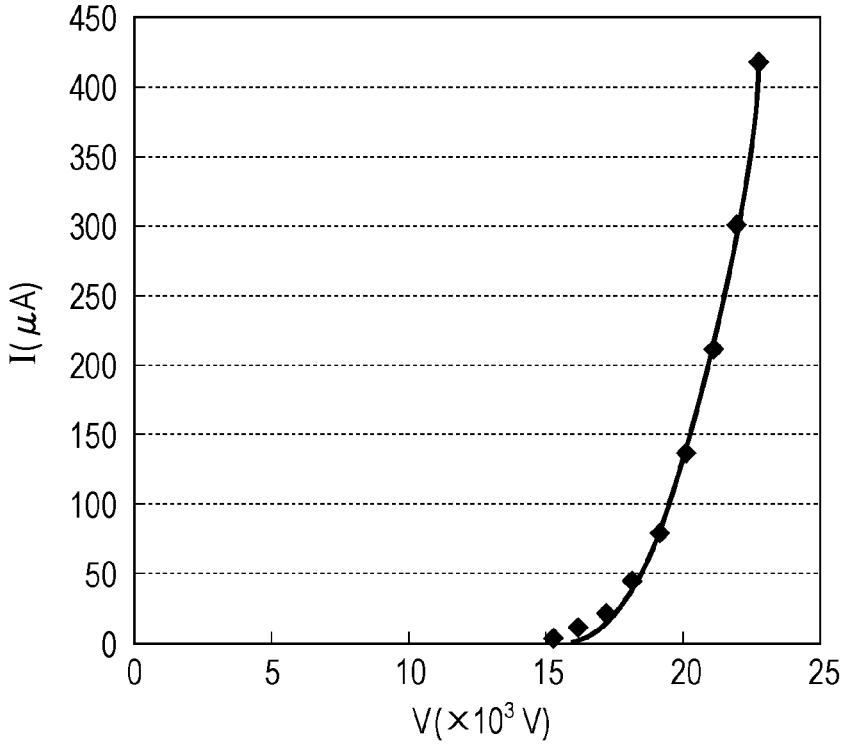
FIGS. 8A and 8B are graphs showing electron emission characteristics.

FIG. 8A shows the electron emission characteristic of the electron-emitting film 6 prepared under the conditions described above. FIG. 8A is a graph showing the relationship between the voltage (V) applied between the anode and the cathode electrode 2 and the emission current (I) flowing in the anode during the voltage application. A current (emission current) I of 420 μA flowed in the anode when a voltage of 23 kV was applied between the cathode electrode 2 and the anode. Accordingly, good electron emission characteristic was confirmed.

After completion of measurement of the electron emission characteristic, the electron-emitting film 6 was subjected to XPS analysis. An Al-kα line (1486.6 eV) was used as the X-ray source for the XPS analysis. The spectrum profile obtained is shown in FIG. 1. The first peak was at 229 eV (position of the peak top) and the full-width at half maximum was 1.8 eV. It was observed that the first peak included a sub peak (third peak) having a peak top at 228.2 eV, which is right beside the position of the aforementioned peak top. A second peak was observed at 232.5 eV (position of the peak top) and the full-width at half maximum was 2.5 eV.

Ten samples were prepared as with the electron-emitting devices described above and analyzed by XPS. For all samples, the first peak had a peak top at a position in the range of 229±0.5 eV and the FWHM was within the range of 1.5 to 2 eV. For all samples, the second peak had a peak top at a position in the range of 232.5±0.5 eV and the FWHM was within the range of 1.5 to 2.7 eV. For all samples, the sub peak had a peak top at a position in the range of 228.1±0.3 eV.

Figure 4A:
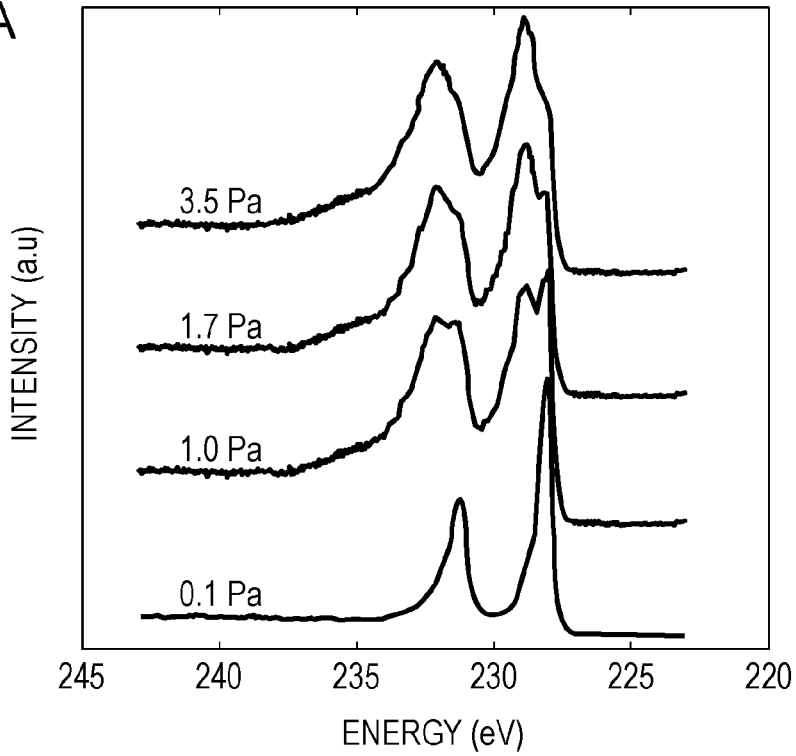
FIGS. 4A and 4B are X-ray photoelectron spectra when conditions of preparation were changed.
Figure 4B:
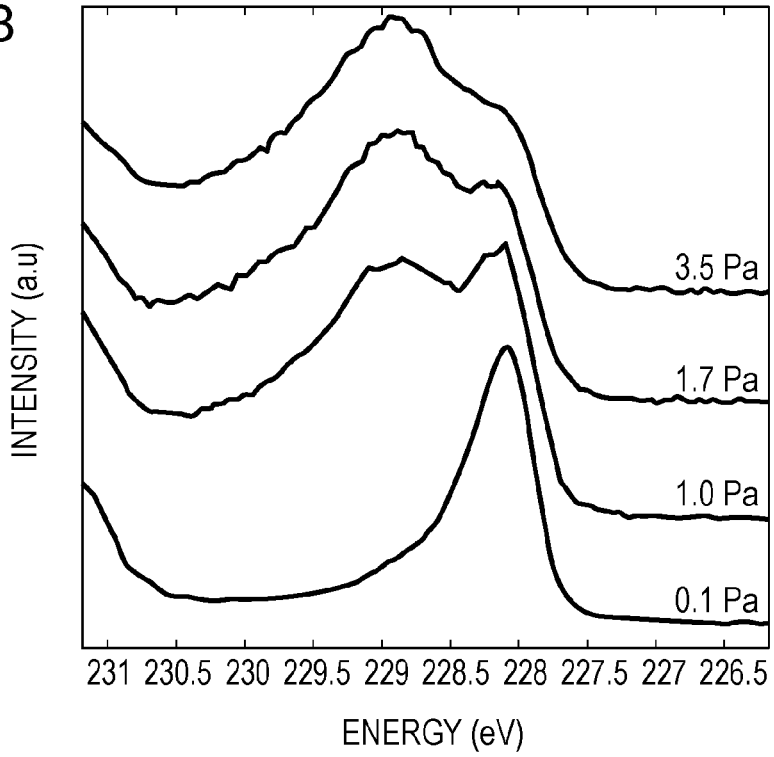

FIG. 4A shows changes in XPS spectrum of the Mo-containing film obtained by varying the conditions under which the Mo-containing film was deposited. FIG. 4B shows the detailed XPS spectra.

Here, changes in the spectrum profiles that occurred when sputtering pressure (total pressure) was varied from 0.1 to 3.5 Pa while other conditions were maintained the same as in Example 1 are shown. As shown in FIG. 4B, as the sputter pressure changes from 0.1 Pa to 3.5 Pa, additional peaks appear.

When the film was formed at 1.0 Pa, the profile had a first peak having a peak top at a position in the range of 229±0.5 eV, and the FWHM was in the range of 1.5 to 2 eV. A sub peak (third peak) having a peak top in the range of 228.1±0.3 eV was also observed. The electron-emitting device made at 1.0 Pa had an emission current I of 390 μA. Although this is slightly lower than that of the electron-emitting device made at 1.7 Pa, a large amount of electron emission can still be retained.

These results show that the presence of the first peak having the sub peak described above is effective for the electron emission characteristics. The results also show that the intensity of the first peak is desirably higher than that of the sub peak (third peak). In other words, the peak top of the first peak in the range of 229±0.5 eV is desirably higher than the peak top of the first peak in the range of 228.1±0.3 eV.

Figure 12A:
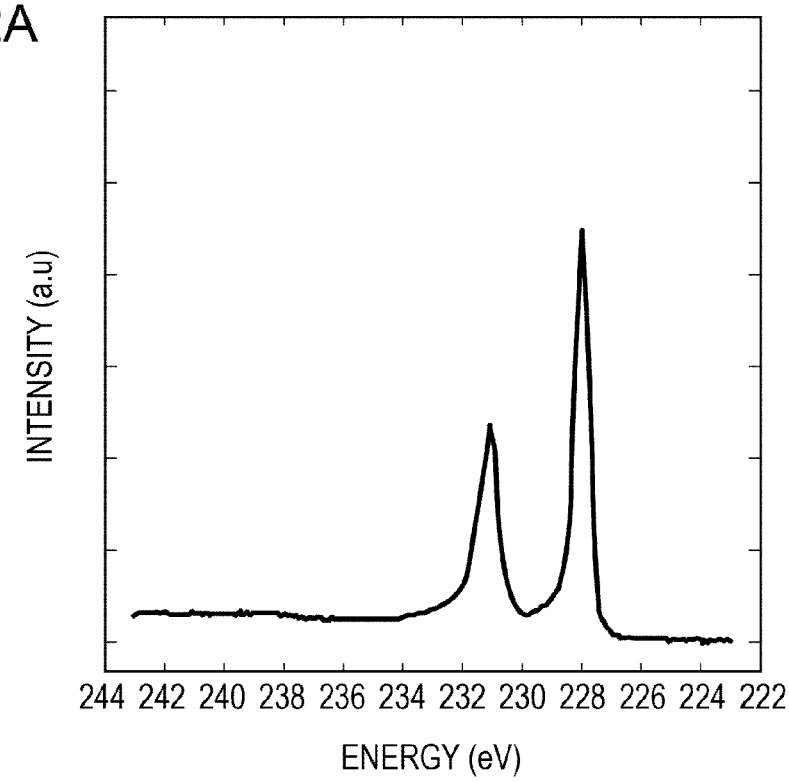
FIGS. 12A to 12C are X-ray photoelectron spectra of Comparative Examples.

For comparison, the same sputtering process was conducted as in Example 1 except that, after oxygen in the chamber 10 had been evacuated below the detection limit, a molybdenum film was deposited on the substrate 1 to a thickness of 200 nm. Then the molybdenum film was milled with Ar ions to a depth of 10 nm from the surface in the XPS analyzer of Example 1. The XPS analysis was conducted in such a state as in Example 1. As a result, a spectrum shown in FIG. 12A was obtained. The spectrum had a first peak having a peak top at 227.9 eV and the FWHM thereof was 0.6 eV. The spectrum also had a second peak having a peak top at 231 eV and the FWHM thereof was 0.9 eV. Since this film can be deemed as a film composed of metallic molybdenum, the first peak can be considered to be equivalent to the peak of Mo3d5/2 and the second peak can be considered to be equivalent to the peak of Mo3d3/2.

Comparative Example 1

In Comparative Example 1, a Mo-containing film was formed by changing the pressure during sputtering compared to Example 1. In particular, the pressure (total pressure) during deposition (sputtering) of the Mo-containing film was set to 0.1 Pa. Other conditions were kept the same as in Example 1 to form the electron-emitting film 6. The measurement of the electron emission characteristics and the XPS analysis were conducted as in Example 1.

Figure 8B:
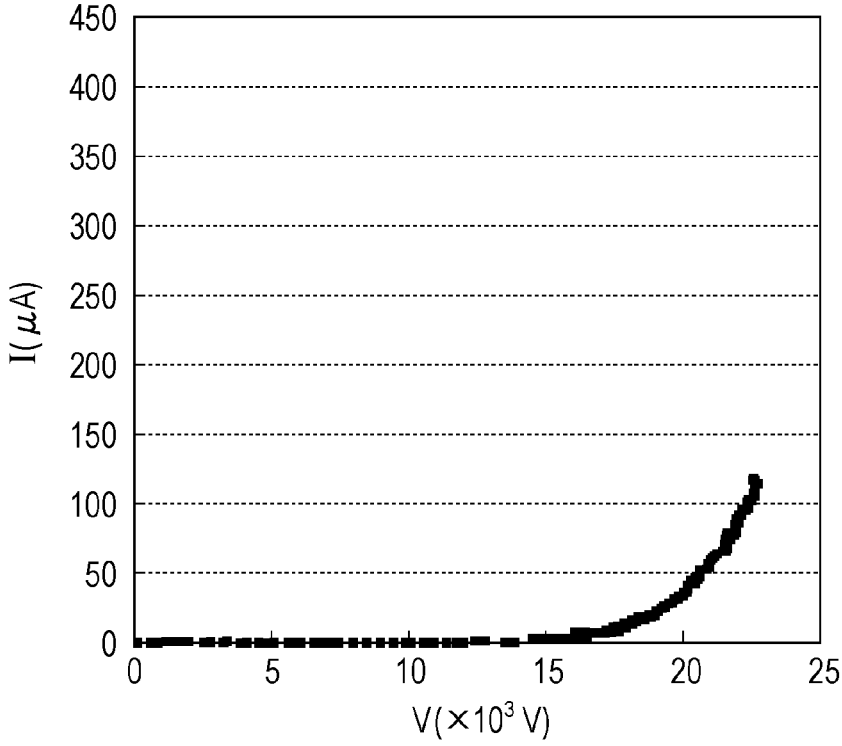

FIG. 8B is a graph showing the electron emission characteristic of the Mo-containing film prepared in Comparative Example 1. As shown in FIG. 8B, a current (emission current) I of only 120 μA flowed in the anode when a voltage of 23 kV was applied between the cathode electrode 2 and the anode.

Figure 3:
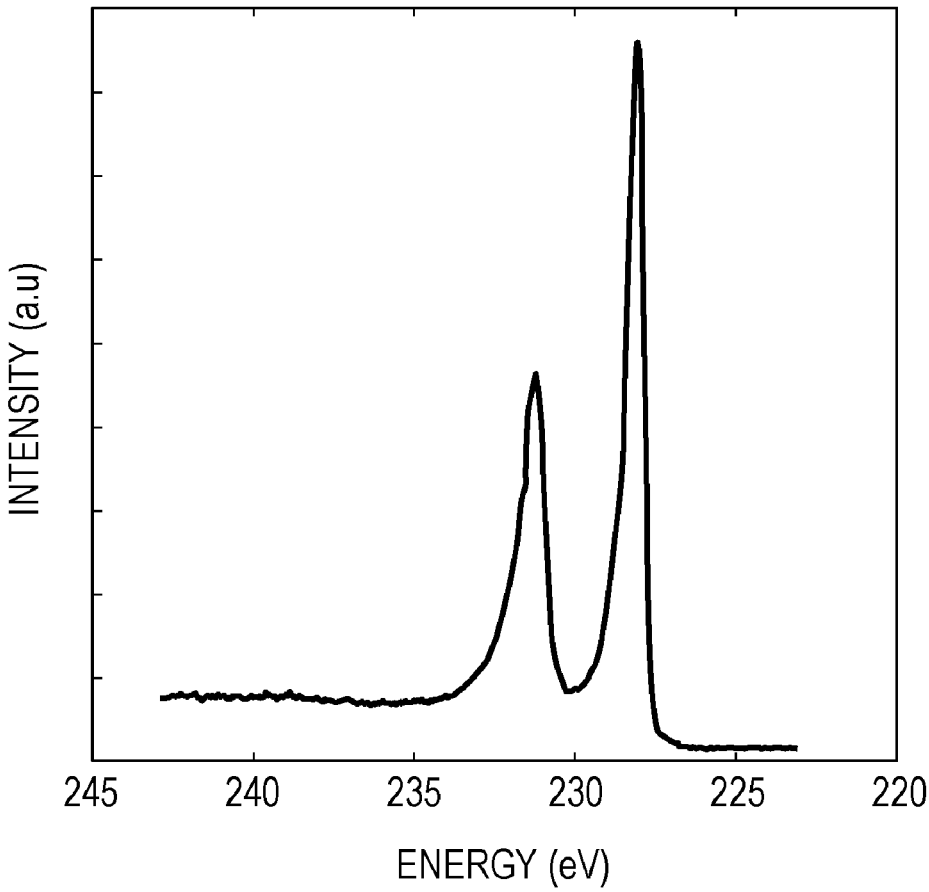
FIG. 3 is an X-ray photoelectron spectrum of Comparative Example.

Next, the Mo-containing film was analyzed by XPS. The spectrum profile obtained is shown in FIG. 3. A sharp first peak having a peak top at 228 eV and a FWHM of 0.6 eV was observed. However, a sub peak similar to that observed in Example 1 was not observed. The second peak had a peak top at 231 eV and the FWHM was 0.9 eV.

Comparative Example 2

In Comparative Example 2, a Mo-containing film was formed as in Example 1, oxidized at 200° C. in air, washed with an alkali and then water as in Example 1, and heated at 400° C. for 1 hour in a vacuum of 1 Pa.

Figure 10A:
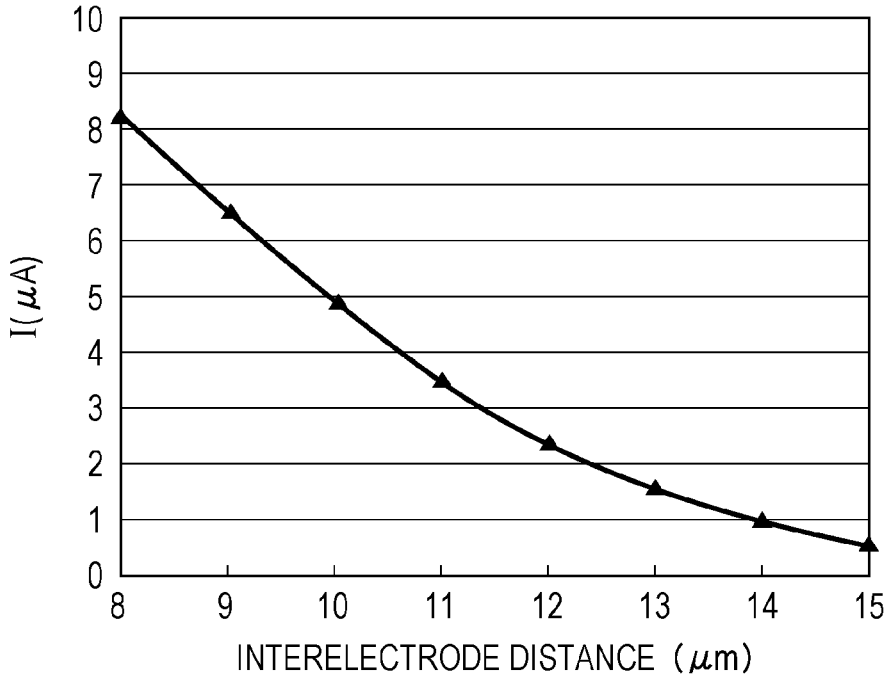
FIGS. 10A and 10B are graphs showing electron emission characteristics.

The electron emission characteristic of the Mo-containing film prepared in Comparative Example 2 was measured as in Example 1. In Comparative Example 2, the emission current (I) was measured while varying the distance between the cathode electrode 2 and the anode. The results are shown in FIG. 10A. The voltage applied between the cathode electrode 2 and the anode was fixed to 23 kV.

Figure 10B:
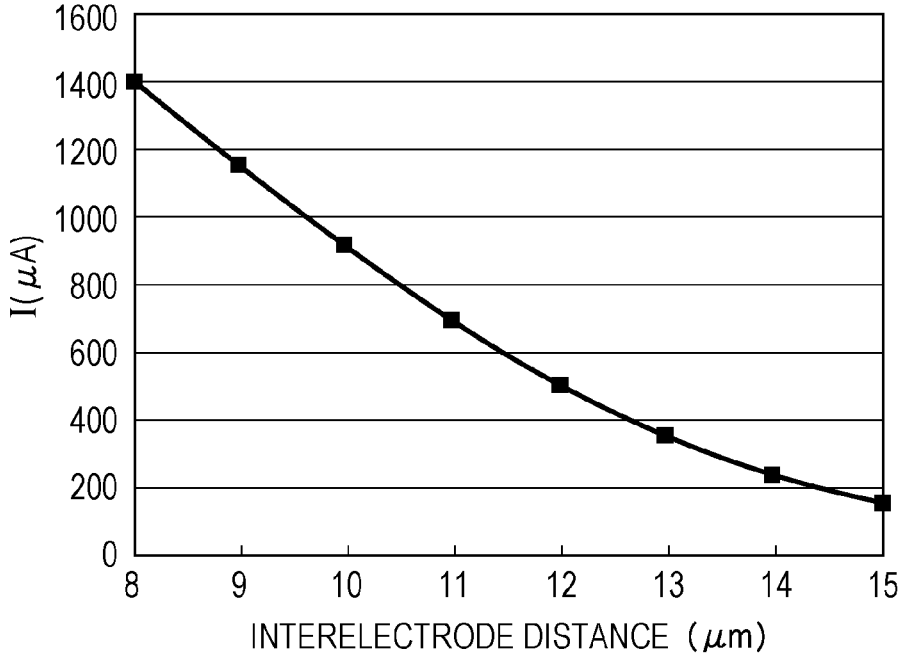

FIG. 10B is a graph showing the electron emission characteristic of a Mo-containing film prepared as in Example 1 measured while varying the distance between the anode and the cathode electrode 2 as in Comparative Example 2. FIG. 10B shows that the emission current obtained from the Mo-containing film of Comparative Example 2 was substantially lower than that of the film of Example 1.

Figure 12B:
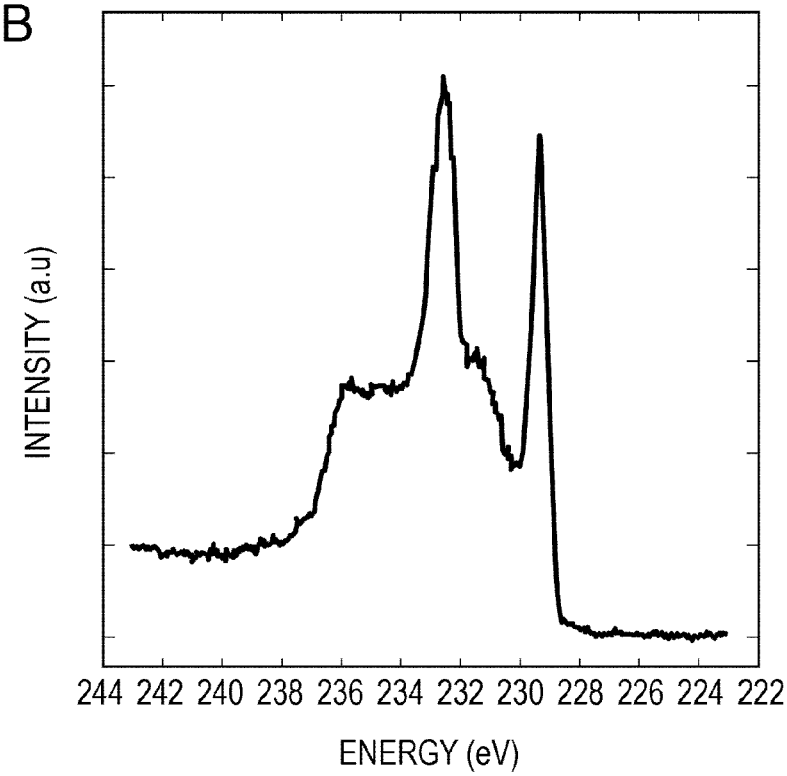

After measuring the electron emission characteristics, the Mo-containing film of Comparative Example 2 was subjected to XPS analysis as in Example 1. The results are shown in FIG. 12B. A sharp first peak was observed. The peak top thereof was at 229.3 eV and the FWHM was 0.7 eV. A sub peak similar to that observed in Example 1 was not observed. A second peak was observed. The second peak had a peak top at 232.5 eV and the FWHM was 2 eV. This also suggests that the presence of the sub peak contributes to the electron emission characteristics.

Comparative Example 3

In Comparative Example 3, a Mo-containing film was formed as in Example 1, oxidized at 400° C. in air, washed with an alkali and then water as in Example 1, and heated at 400° C. for 1 hour in a vacuum of 1 Pa.

The electron emission characteristic of the Mo-containing film prepared in Comparative Example 3 was measured as in Example 1. However, when the emission current (I) was measured by fixing the voltage V applied between the cathode electrode 2 and the anode to 23 kV while varying the distance between the cathode electrode 2 and the anode, no emission current was observed.

Figure 12C:
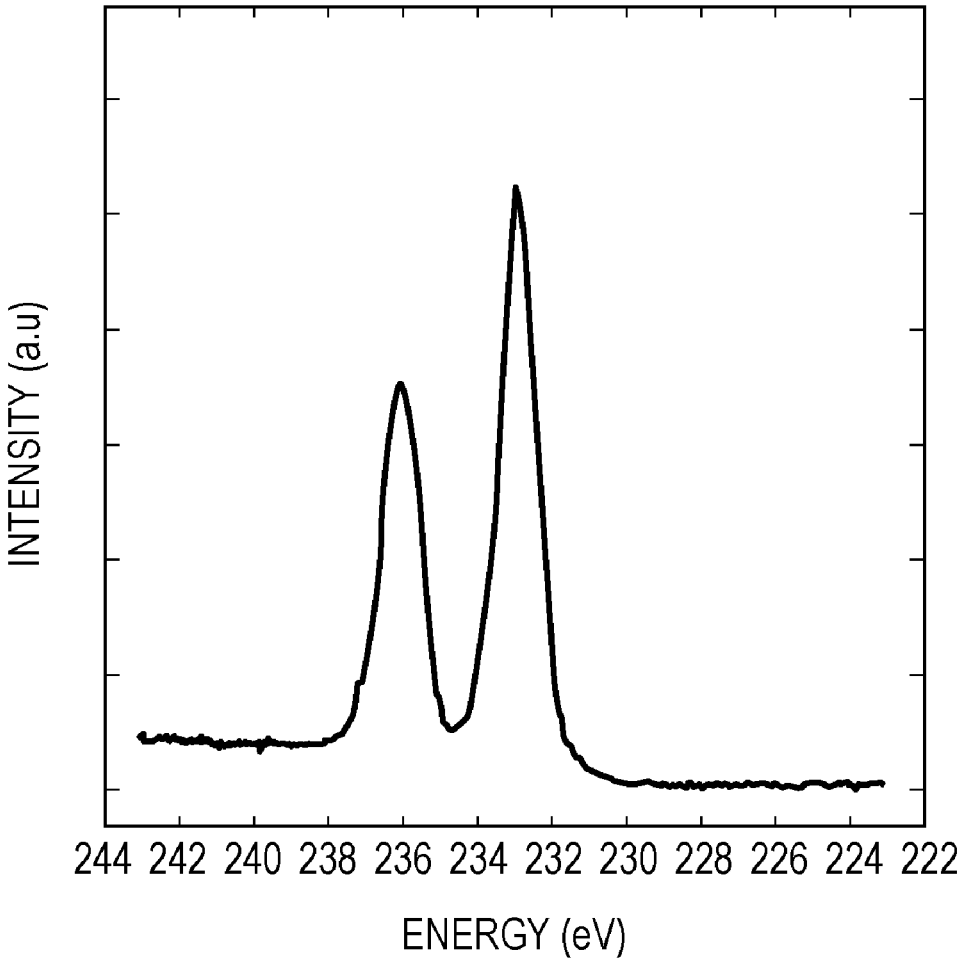

After measuring the electron emission characteristic, the Mo-containing film of Comparative Example 3 was subjected to XPS analysis as in Example 1. As a result, as shown in FIG. 12C, a first peak having a peak top at 232.8 eV and a second peak having a peak top at 235.9 eV were observed. A sub peak (third peak) similar to that observed in Example 1 was not observed.

Comparative Example 4

In Comparative Example 4, a Mo-containing film was prepared as in Example 1 except that the pressure of sputtering was changed to 3.5 Pa and the thickness was changed to 40 nm.

The electron emission characteristic of the Mo-containing film of Comparative Example 4 was measured as in Example 1. Electron emission was not confirmed when the voltage V applied between the cathode electrode 2 and the anode was set to 23 kV.

After measuring the electron emission characteristic, the Mo-containing film of Comparative Example 4 was subjected to XPS analysis as in Example 1. As a result, a first peak having a peak top at 229 eV was observed and the full-width at half maximum was 2.1 eV. A sub peak (third peak) similar to that that observed in Example 1 was not observed.

A second peak having a peak top at 232 eV was observed and the full-width at half maximum was 2.8 eV.

Example 2

FIGS. 6A to 6C are schematic views of a structure of an electron-emitting device of Example 2. FIG. 6A is a schematic plan view of the electron-emitting device. FIG. 6B is a schematic cross-sectional view taken along line VIB-VIB in FIG. 6A. FIG. 6C is a side view of the structure shown in FIGS. 6A and 6B viewed from the right-hand side.

The electron-emitting device of Example 2 includes an insulating layer 3 deposited on a surface of a substrate 1 and a gate electrode 4 disposed on the upper surface of the insulating layer 3 so as to sandwich the insulating layer 3 between the substrate 1 and the gate electrode 4. The electron-emitting device further includes an electron-emitting film 6 disposed on a side surface of the insulating layer 3. Part of the electron-emitting film 6 extends to part of an upper surface (3*c*, 3*e*) of the insulating layer 3 and has a plurality of projections 16.

The projections 16 are aligned along a corner portion 32, which is the border between a side surface (3*f* in FIG. 6B) and an upper surface (3*e* in FIG. 6B) of the insulating layer 3. Each of the projections 16 corresponds to an electron-emitting unit. A gap 8 is formed between the projections 16 of the electron-emitting device and the gate electrode 4. When a voltage is applied between the electron-emitting film 6 and the gate electrode 4 so that the potential of the gate electrode 4 is higher than the potential of the electron-emitting film 6, field emission of electrons occurs from the projections 16 of the electron-emitting film 6. Electrons emitted from the projections 16 are generally scattered on the side surface 5*a* of the gate electrode 4. The position of the gate electrode 4 is not limited to that shown in FIGS. 6A to 6C. In other words, the gate electrode 4 may be placed in any position with a particular distance to the electron-emitting film such that application of an electric field sufficient to induce field emission to the projections 16 serving as the light-emitting unit is possible.

In the example shown here, the insulating layer 3 is a multilayer structure that includes a first insulating layer 3*a* and a second insulating layer 3*b*; alternatively, the insulating layer 3 may be a single insulating layer or may include three or more insulating layers. In the example shown in FIGS. 6A to 6C, the second insulating layer 3*b* is stacked on part of the upper surface 3*e* of the first insulating layer 3*a*. That is, the side surface 3*d* of the second insulating layer 3*b* is farther away from the electron-emitting film 6 than the side surface 3*f* of the first insulating layer 3*a*. According to this structure, the upper surface of the insulating layer 3 has a recess 7. In other words, a step is formed in the upper surface of the insulating layer 3. Although FIGS. 6A to 6C show an example in which a film 6B composed of the same material as the electron-emitting film 6 is formed, this film 6B may be omitted. The film 6B composed of the same material as the electron-emitting film 6 is spaced from the electron-emitting film 6 and is connected to the gate electrode 4. Accordingly, when the film 6B composed of the same material as the electron-emitting film 6 is formed, the film 6B serves as a part of the gate electrode.

A method for making the electron-emitting device of Example 2 will now be described with reference to FIGS. 9A to 9F.

Figure 9A:
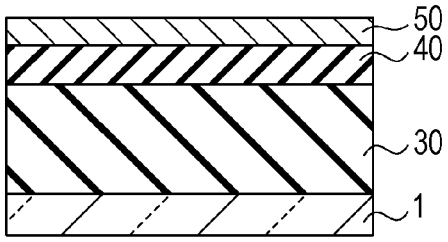
FIGS. 9A to 9F are schematic diagrams showing steps of making an electron-emitting device.

As shown in FIG. 9A, insulating layers 30 and 40, and a conductive layer 50 were sequentially stacked on the substrate 1. A high-strain-point, low-sodium glass (PD200 produced by Asahi Glass Co., Ltd.) was used as the substrate 1.

The insulating layer 30 was a silicon nitride film formed by sputtering and had a thickness of 500 nm. The insulating layer 40 was a silicon oxide film formed by sputtering and had a thickness of 30 nm. The conductive layer 50 was a tantalum nitride film formed by sputtering and had a thickness of 30 nm.

Figure 9B:
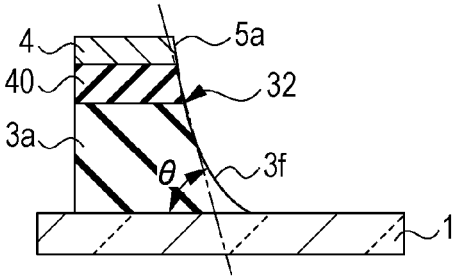

Next, as shown in FIG. 9B, the conductive layer 50, the insulating layer 40, and the insulating layer 30 were processed in that order by dry-etching after lithographically forming a resist pattern on the conductive layer 50. The conductive layer 50 and the insulating layer 30 patterned as a result of this first etching process respectively serve as the gate electrode 4 and the first insulating layer 3*a*. $CF_4$-based gas was used as the etching gas since materials that form fluorides were selected as the materials for the insulating layers 30 and 40 and the conductive layer 50. Reactive ion etching (RIE) was carried out using this gas. As a result, the angle of the side surfaces (3*f*, 5*a*) of the insulating layers (referenced by 3*a* and 40 in FIG. 9B) and the gate electrode 4 was about 60° with respect to the substrate surface (level surface).

Figure 9C:
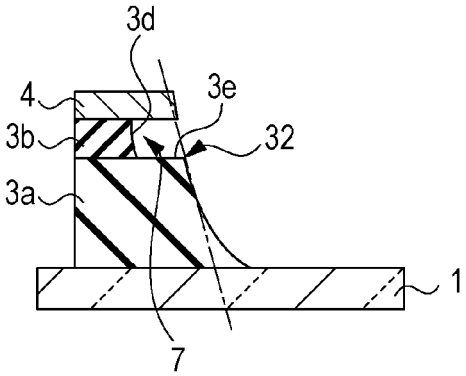

After removal of the resist, as shown in FIG. 9C, buffered hydrofluoric acid (BHF) (high-purity buffered hydrofluoric acid LAL100 produced by Stella Chemifa Corporation) was used to etch the insulating layer 40 so that the depth of the recess 7 was about 70 nm. The BHF was a mixture of 0.9 wt % $NH_4HF_2$ and 16.4 wt % $NF_4F$. By this second etching process, the recess 7 was formed in the insulating layer 3 including the first insulating layer 3*a* and the second insulating layer 3*b*.

Figure 9D:
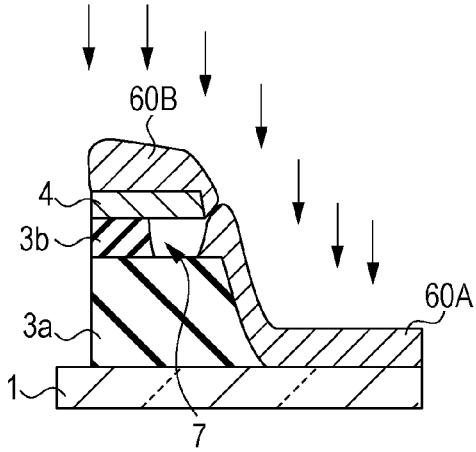

Next, as shown in FIG. 9D, molybdenum was deposited by directional sputtering on a slope 3*f* and an upper surface 3*e* of the first insulating layer 3*a* and the gate electrode 4 under the same conditions as in Example 1 so that at least the thickness of the molybdenum layer deposited on the slope 3*f* of the first insulating layer 3*a* was 35 nm.

Here, the substrate 1 was set such that the surface was level with respect to the sputter target. In this example, a shield plate was provided between the substrate 1 and the target so that the sputtered particles entered the surface of the substrate 1 at a limited angle (in particular, 90±10° with respect to the surface of the substrate 1). The power of the argon plasma during sputtering was set to 1 W/cm$^2$, the distance between the substrate 1 and the target was set to 100 mm, and the total pressure was set to 1.7 Pa. The sputter gas was Ar and $O_2$, and the partial pressure ratio was 9:1. An electrically conductive film 60A was formed so that the amount of penetration of the electrically conductive film 60A into the recess 7 was 35 nm.

The electrically conductive film 60A and an electrically conductive film 60B were formed simultaneously as such. The electrically conductive film 60A was in contact with the electrically conductive film 60B.

Figure 9E:
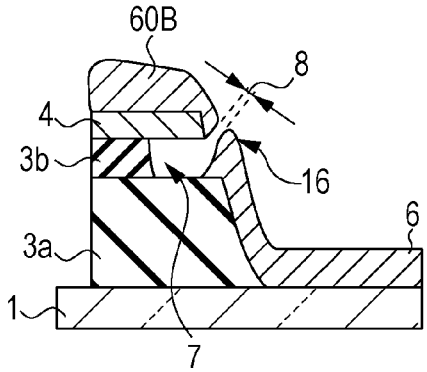

Next, as shown in FIG. 9E, the electrically conductive film 60A and the electrically conductive film 60B were wet-etched (third etching process). The etchant used was 0.24 wt % tetramethylammonium hydride (TMAH). The electrically conductive film 60A and the electrically conductive film 60B were immersed in this etchant for 40 seconds and then washed with running water for 5 minutes. Then heat treatment was conducted at 400° C. in a vacuum of 1 Pa for 1 hour to form an electron-emitting film 6 having many projections 16 aligned along a corner portion 32 and to form the gap 8.

Figure 9F:
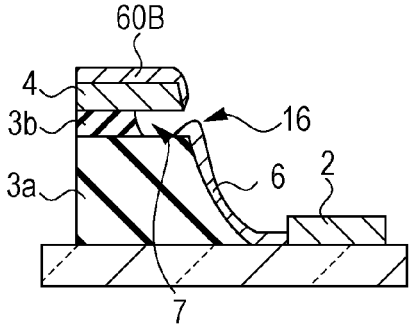

Lastly, as shown in FIG. 9F, a cathode electrode 2 was formed to connect to the electron-emitting film 6. Copper (Cu) was used as the material for the cathode electrode 2. The cathode electrode 2 was made by sputtering and had a thickness of 500 nm.

The electron-emitting film 6 of the electron-emitting device formed as such was analyzed by XPS as in Example 1. A spectrum similar to one shown in FIG. 1 of Example 1 (a spectrum including a sub peak) was observed. The spectrum was substantially the same irrespective of the positions in the electron-emitting film 6.

Next, the electron emission characteristics of the electron-emitting device of Example 2 were measured. In the measurement, an anode was provided 1.7 mm above the substrate 1, a voltage of 10 kV was applied between the anode and the cathode electrode 2, and a drive voltage V of 20 V was applied between the cathode electrode 2 and the gate electrode 4. As a result, emission current having a magnitude of about 29 μA was obtained. The electron emission efficiency was 7%. Excellent electron emission characteristics were obtained. When the current flowing between the electron-emitting film 6 and the gate (gate electrode 4 and electrically conductive film 60B) is assumed to be the element current, the electron emission efficiency is a value expressed by emission current/electron emission current×100(%).

As discussed above, an electron-emitting device having a good electron emission characteristic can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-289728, filed Dec. 21, 2009, which is hereby incorporated by reference herein in its entirety.

What is claimed is:

1. An electron-emitting device comprising:

an electron-emitting film containing molybdenum, wherein a spectrum obtained by measuring a surface of the electron-emitting film by X-ray photoelectron spectroscopy has a first peak having a peak top in the range of 229±0.5 eV and a sub peak having a peak top in the range of 228.1±0.3 eV.

2. The electron-emitting device according to claim 1, wherein an intensity of the first peak is greater than an intensity of the sub peak.

3. The electron-emitting device according to claim 1, wherein a full width at half maximum of the first peak is 1.5 to 2 eV.

4. The electron-emitting device according to claim 1, wherein the spectrum also has a second peak having a peak top in the range of 232.5±0.5 eV and a full width at half maximum of 1.5 to 2.7 eV.

5. An electron source comprising:

a plurality of electron-emitting devices, each being the electron-emitting device according to claim 1.

6. An image display apparatus comprising:

a plurality of electron-emitting devices; and a light-emitting member that emits light when irradiated with electrons emitted from the plurality of electron-emitting devices, wherein each of the plurality of electron-emitting devices is the electron-emitting device according to claim 1.

* * * * *